US010161104B2

(12) United States Patent
Andou et al.

(10) Patent No.: US 10,161,104 B2
(45) Date of Patent: Dec. 25, 2018

(54) FRONT ATTACHMENT IN TRAVELING MACHINE BODY FOR OPERATION

(71) Applicant: Caterpillar SARL, Geneva (CH)

(72) Inventors: Hiroaki Andou, Tokyo (JP); Ryo Iguchi, Tokyo (JP); Hidetaka Ishizuka, Tokyo (JP); Teruyuki Yamada, Hyogo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/534,612

(22) PCT Filed: Dec. 17, 2015

(86) PCT No.: PCT/EP2015/080204

§ 371 (c)(1),
(2) Date: Jun. 9, 2017

(87) PCT Pub. No.: WO2016/097133

PCT Pub. Date: Jun. 23, 2016

(65) Prior Publication Data

US 2017/0335542 A1 Nov. 23, 2017

(30) Foreign Application Priority Data

Dec. 18, 2014 (JP) ..... 2014-256339

(51) Int. Cl.

| | |
|---|---|
| ***E02F 3/96*** | (2006.01) |
| ***E02F 3/40*** | (2006.01) |
| ***E02F 3/413*** | (2006.01) |
| *E02F 3/32* | (2006.01) |

(52) U.S. Cl.

CPC ..... *E02F 3/964* (2013.01); *E02F 3/404* (2013.01); *E02F 3/4135* (2013.01); *E02F 3/32* (2013.01)

(58) Field of Classification Search

CPC ..... E02F 3/964; E02F 3/404; E02F 3/4135; E02F 3/32

USPC ..... 294/87.21, 87.26, 96, 97, 100, 103.1, 294/106, 50.5, 50.6, 50.8, 81.61, 81.62;

(Continued)

(56) References Cited

U.S. PATENT DOCUMENTS 270,085 A * 1/1883 Lewis ..... B25C 11/02 254/24
757,162 A * 4/1904 Welsh ..... B25C 11/02 254/23

(Continued)

FOREIGN PATENT DOCUMENTS

| | | |
|---|---|---|
| CA | 2364936 A1 | 6/2003 |
| JP | 2003-336280 A | 11/2003 |
| JP | 4-936784 B2 | 5/2012 |

*Primary Examiner* — Jamie L McGowan

(57) ABSTRACT

To set time difference to the starting time of excavation and scooping by setting the starting of the scooping with a bucket behind the starting of the excavation with a ripper in an excavation machine where the bucket and the ripper are equipped to an arm, and are manipulated to open and close with each other by expansion and contraction of a hydraulic cylinder. During the first half of the contracting process at a hydraulic cylinder, a pin mounted on a connecting link where a bucket and a ripper are connected moves through a slot formed on the bucket to make bucket delay in closing, and the bucket and the ripper close at the same time during the latter half of the contracting process.

2 Claims, 12 Drawing Sheets

(58) Field of Classification Search
USPC ..... 37/406, 302; 144/336, 338, 339, 343; 254/23; 414/23
See application file for complete search history.

(56) References Cited

U.S. PATENT DOCUMENTS 1,563,255 A * 11/1925 Couch ..... A01B 43/00 294/106
1,648,637 A * 11/1927 Carr ..... E02F 3/188 37/189
2,370,411 A * 2/1945 Otino ..... B66C 1/48 294/104
3,110,477 A * 11/1963 Campbell ..... A01G 17/16 254/132
3,243,905 A * 4/1966 Ulrich ..... E02F 3/4133 172/831
3,262,731 A * 7/1966 Renfroe ..... B66C 1/48 294/101
3,352,589 A * 11/1967 Kilboy ..... B65G 7/12 294/104
3,625,268 A * 12/1971 Kempe ..... A01G 23/089 144/34.1
3,659,890 A * 5/1972 Renfroe ..... B66C 1/48 294/104
3,946,776 A * 3/1976 Oldenburg ..... A01G 23/089 144/34.5
3,974,925 A * 8/1976 McKenzie ..... A01G 23/065 144/34.2
4,037,397 A * 7/1977 Fiorentino ..... A01D 7/10 294/50.8
4,097,084 A * 6/1978 Russell ..... B66C 1/422 294/104
4,283,866 A * 8/1981 Ogawa ..... E02F 3/404 37/406
4,375,345 A * 3/1983 Hanson ..... E02F 3/963 37/406
4,519,739 A * 5/1985 Risch ..... E02F 3/404 29/428
4,525,929 A * 7/1985 Brophy, Sr. ..... A01G 3/0251 30/181
4,803,788 A * 2/1989 Sorenson ..... E02F 3/404 37/406
5,062,227 A * 11/1991 De Gier ..... E02F 3/965 294/104
5,094,581 A * 3/1992 Lamb ..... A01D 87/0076 37/405
5,472,308 A * 12/1995 Somero ..... E02F 3/404 37/406
5,553,408 A * 9/1996 Townsend ..... E02F 3/404 37/406
5,921,302 A * 7/1999 Petersen ..... A01G 23/06 144/24.12
5,927,933 A * 7/1999 Tucker ..... E02F 3/404 37/403
6,010,294 A * 1/2000 Lyddon ..... A01G 23/06 37/302
6,058,632 A * 5/2000 Hawkins ..... B23D 17/00 37/406
6,370,801 B1 * 4/2002 Weyer ..... E02F 3/404 37/406
6,857,619 B1 * 2/2005 Jangula ..... E02F 3/96 254/132
7,111,419 B1 * 9/2006 Miller ..... E02F 3/404 37/406
7,160,077 B2 * 1/2007 Westendorf ..... B66C 1/585 294/106
7,240,441 B2 * 7/2007 McCoy ..... E02F 3/404 37/403
7,334,658 B2 * 2/2008 Berg ..... B62D 1/12 180/333
8,827,626 B2 * 9/2014 Seljestad ..... E02F 3/404 37/403
8,920,106 B2 * 12/2014 Seljestad ..... E02F 3/404 37/406
2004/0093770 A1 * 5/2004 Clapper ..... E02F 3/404 37/406
2004/0261301 A1 * 12/2004 Vering ..... E02F 3/404 37/403
2005/0193599 A1 * 9/2005 McCoy ..... E02F 3/404 37/406
2005/0211960 A1 * 9/2005 Wagner ..... B25B 7/12 254/22
2006/0150446 A1 * 7/2006 Ottoni ..... E02F 3/404 37/406
2006/0248754 A1 * 11/2006 Martin ..... A01G 23/06 37/302
2008/0011155 A1 * 1/2008 Connolly ..... E02F 3/404 91/508
2009/0077840 A1 * 3/2009 Zeno ..... E02F 3/3604 37/468
2012/0163950 A1 * 6/2012 Seljestad ..... E02F 3/404 414/722
2013/0115038 A1 * 5/2013 Bargellini ..... A01G 23/06 414/724
2013/0270849 A1 * 10/2013 Daniel ..... B66C 1/54 294/96
2015/0328068 A1 * 11/2015 Hruschka ..... A61G 13/06 5/610
2016/0102444 A1 * 4/2016 Toraason ..... E02F 3/404 37/406

* cited by examiner

FRONT ATTACHMENT IN TRAVELING MACHINE BODY FOR OPERATION

CROSS-REFERENCE TO RELATED APPLICATIONS

This application is a national phase application of International Patent Application No. PCT/EP2015/080204 filed Dec. 17, 2015, which claims priority to Japanese Patent Application No. 2014-256339 filed Dec. 18, 2014, both of which are incorporated by reference herein in their entireties for all purposes.

TECHNICAL FIELD

The present invention relates to the technical field of a front attachment in a traveling machine body for operation such as a hydraulic shovel.

BACKGROUND ART

Generally, in a known traveling machine body for operation such as a hydraulic shovel, a first operating body such as a bucket and a second operating body such as a ripper are provided as a front attachment to be openable and closable, such that a dug object dug with the second operating body is scooped with the first operating body and wood and the like is held (sandwiched) with the two operating bodies (e.g., see PTL 1 and 2).

CITATION LIST

Patent Literature

[PTL 1]
Japanese Utility Model Application Laid-open No. H2-136148
[PTL 2]
Japanese Patent No. 4936784

SUMMARY OF INVENTION

Technical Problem

However, since the configuration in PTL 1 is such that a dedicated hydraulic cylinder is provided to each of the respective operation arms to open or close the two operating bodies, there is a problem in that the number of parts becomes large and that tremendous burden is placed particularly on an inexperienced operator due to a troublesome manipulation being required for a complicated mechanism for separately operating the two hydraulic cylinders.

In contrast, in PTL 2, an opening or closing operation of the two operating bodies is performed with one hydraulic cylinder, thereby overcoming the drawback of PTL 1 described above such as the number of parts becoming large or the burden on an operator being large. However, the opening or closing operation of the two operating bodies are simultaneous in the case of an extending or contracting operation of the hydraulic cylinder herein, and therefore, despite there being not much trouble in the case of a simple holding operation, there is a problem of a disadvantage in operation performance due to a scooping operation being too early in the case where two operations are involved such as the first operating body scooping an object dug with the second operating body; here lies the problem to be solved by the present invention.

Solution to Problem

The present invention has been created for the purpose of solving these problems in view of the circumstances as described above. An invention of claim 1 is a front attachment in a traveling machine body for operation, including: a first operating body provided to be swingable at a tip end section of an arm; a second operating body provided to be swingable at an intermediate section of the arm; a hydraulic cylinder of which a base end section is provided to the arm and a tip end section is provided to a base end section of the second operating body; and a connecting link that connects the first operating body and the second operating body, the first operating body and the second operating body being configured to perform an opening or closing operation along with an extending or contracting operation of the hydraulic cylinder, wherein operation delaying means for delaying a closing operation of the first operating body by causing the second operating body to perform a closing operation in advance in a process of contracting the extended hydraulic cylinder is provided to a connecting section for the first operating body and the connecting link.

An invention of claim 2 is the front attachment in a traveling machine body for operation according to claim 1, wherein the operation delaying means includes a slot provided to the first operating body and a pin provided to the connecting link to be movable in the slot, and is configured to cause only the second operating body to perform the closing operation in advance by the pin moving in the slot in a first half of the process of contracting the hydraulic cylinder, and cause both of the first operating body and the second operating body to perform the closing operation in a second half of the process of contracting the hydraulic cylinder after the pin has moved to a moving end of the slot, thus delaying the closing operation of the first operating body with respect to the closing operation of the second operating body.

An invention of claim 3 is the front attachment in a traveling machine body for operation according to claim 1 or 2, wherein the first operating body is a bucket, and the second operating body is a ripper.

Advantageous Effects of Invention

With the invention of claim 1, the second operating body first performs the closing operation alone, and then the first and second operating bodies perform the closing operation together, in the process of contracting the one hydraulic cylinder. As a result, smoothly performing an operation with a time lag such as the first operating body scooping an object dug with the second operating body can be easy even for an inexperienced operator. With the invention of claim 2, the operation delaying means for delaying the closing operation of the first operating body by causing the second operating body to perform the closing operation in advance can be configured easily.

With the invention of claim 3, an object first dug with the ripper can be scooped with the bucket with a time lag, in the digging of hard soil. Thus, the operation performance is improved, and early wear of the bucket as in the case where the bucket performs all of such digging and scooping operations can be avoided.

DESCRIPTION OF EMBODIMENTS

Figure 1:
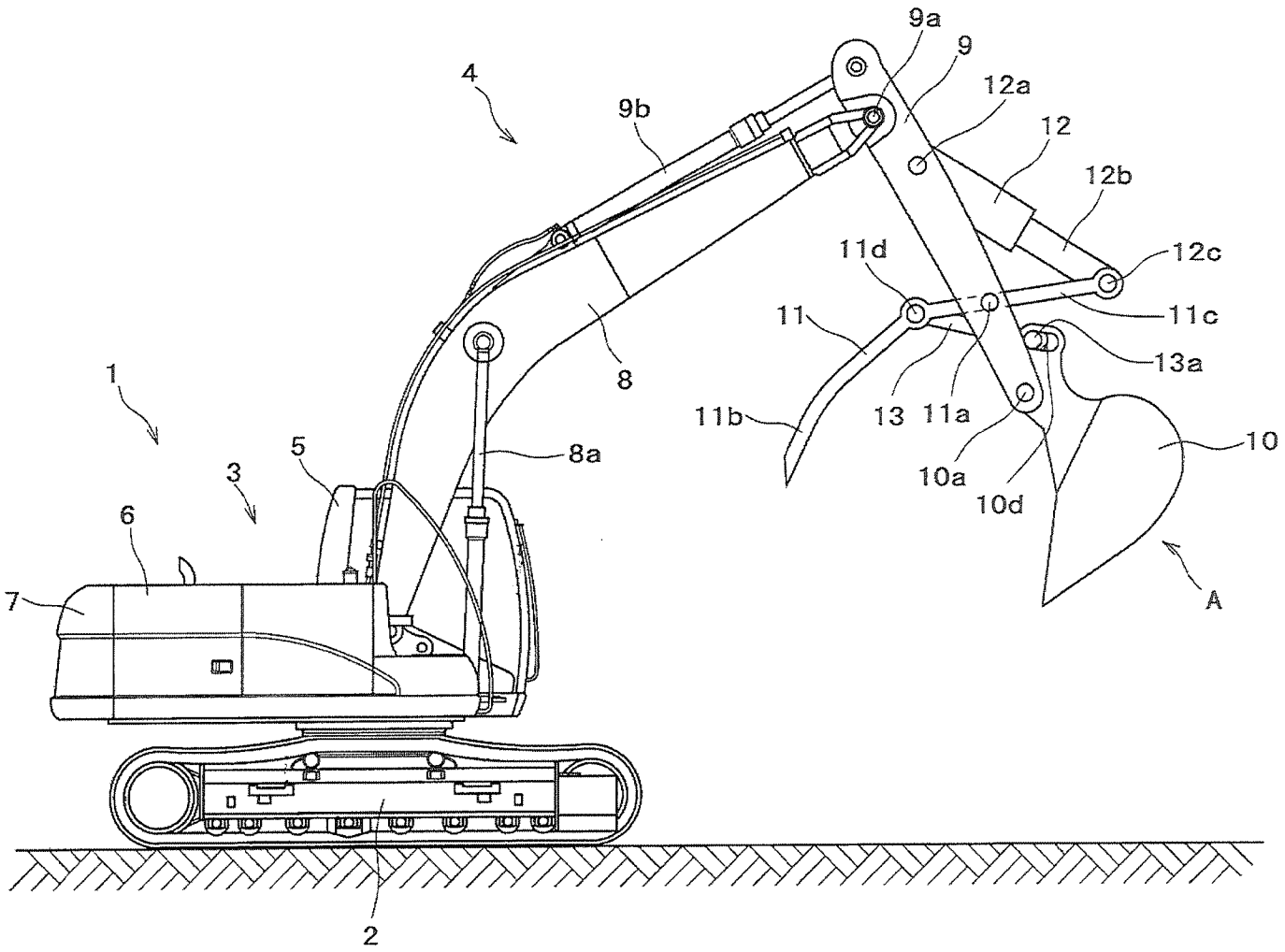
FIG. 1 is an overall side view of a hydraulic shovel.
Figure 2:
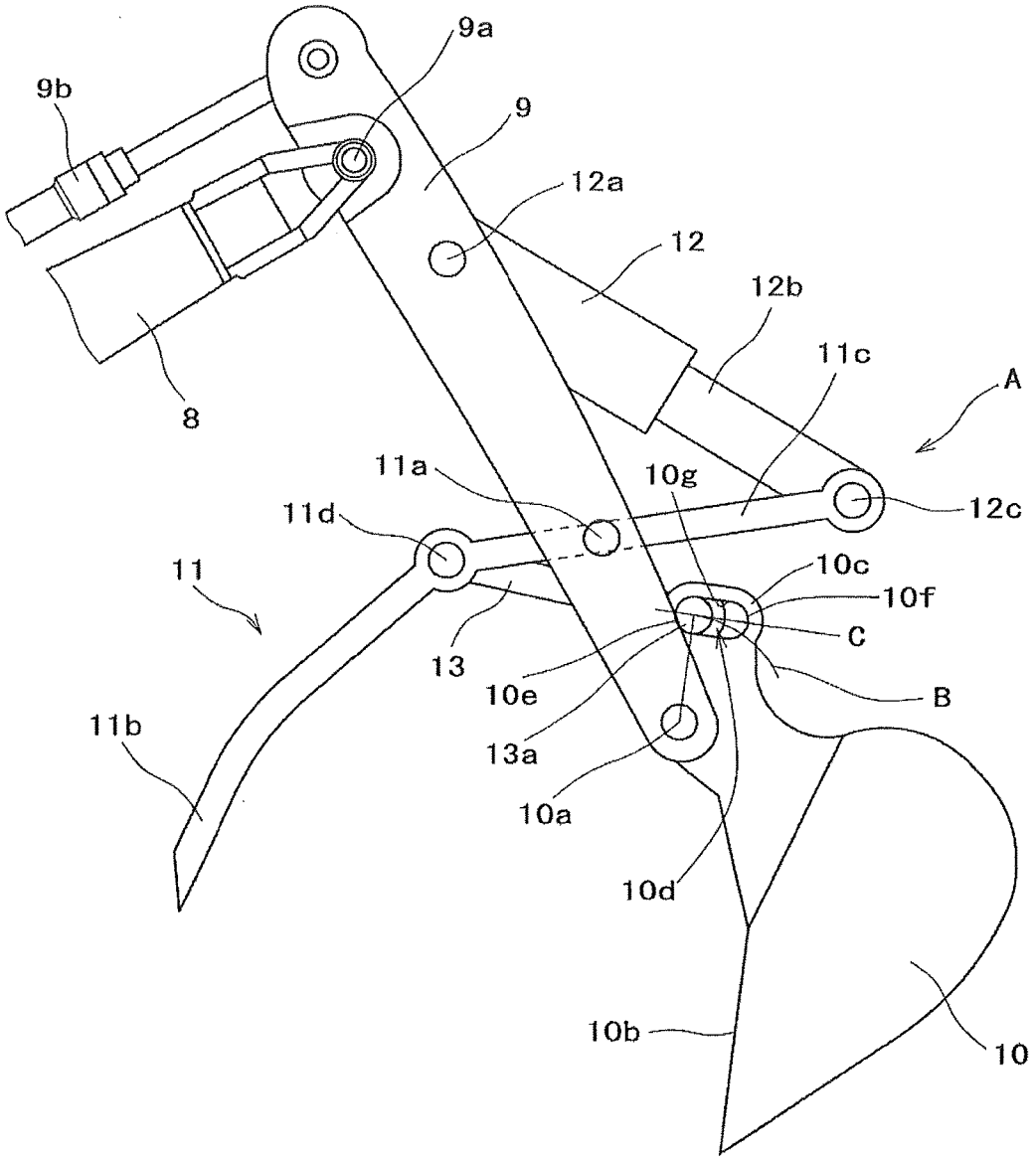
FIG. 2 is a side view of a front attachment.
Figure 3:
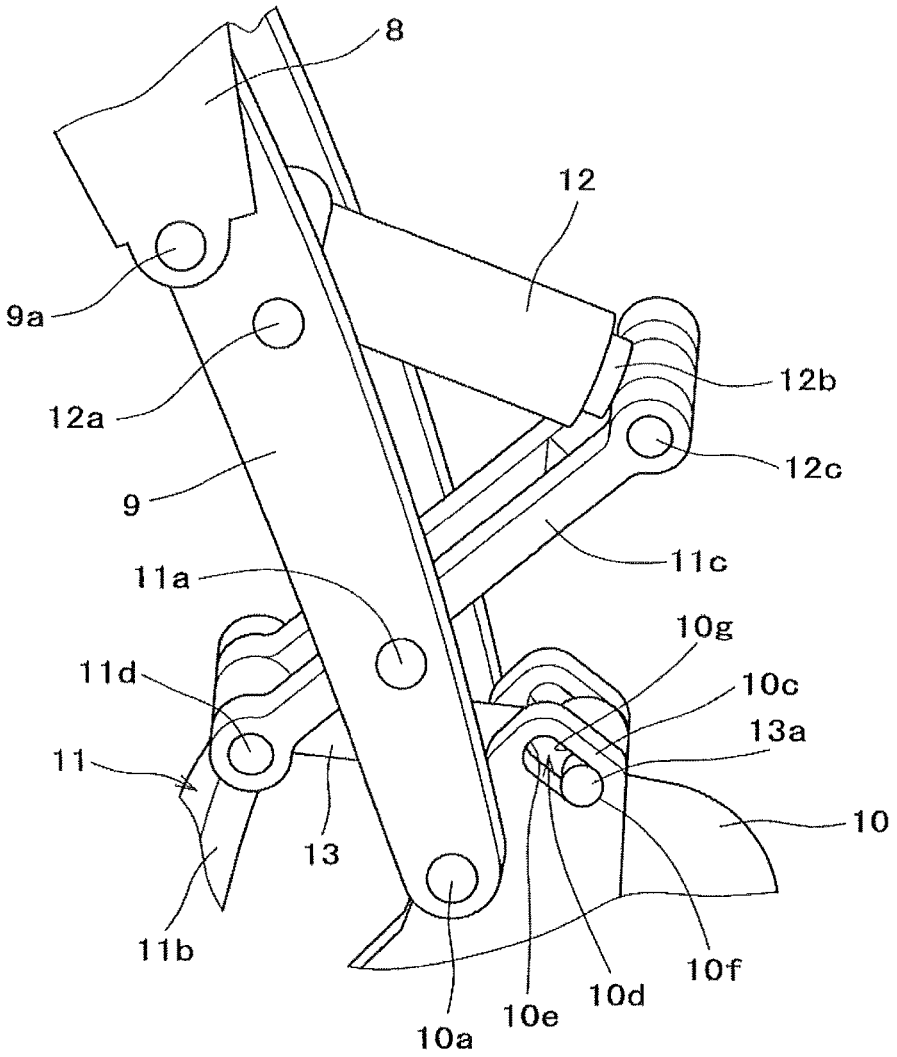
FIG. 3 is a perspective view of the main section of the front attachment.

An embodiment for carrying out the present invention will be described below based on the drawings. In the drawings, 1 denotes a traveling machine body of a hydraulic shovel. In the traveling machine body 1, an upper slewing body 3 is mounted on a crawler-type lower traveling body 2 to be capable of slewing about a vertical axis. In the upper slewing body 3, the configuration including various member devices such as a front operation section 4, an operator's cab (cab) 5, an engine room 6, and a counterweight 7, which are to be described later, is in accordance with the prior art.

The front operation section 4 is provided with a boom 8 of which the base end section is axially supported to be rotatable at the upper slewing body 3 and that is moved up and down by an extending or contracting operation of a boom cylinder 8*a*, an arm (stick) 9 that is axially supported to be rotatable at the tip end section of the boom 8 with a supporting shaft 9*a* and moved dump and crowd by an extending or contracting operation of an arm cylinder 9*b*, and a front attachment A with which the present invention is carried out at the tip end section (front end section) of the arm 9. The front attachment A is configured as follows. First, a bucket (corresponding to "first operating body" of the present invention) 10 axially supported to be rotatable at the tip end section of the arm 9 with a supporting shaft 10*a* is provided, and the intermediate section of a ripper (corresponding to "second operating body" of the present invention) 11 is axially supported to be swingable at the intermediate section of the arm 9 in the length direction with a first supporting shaft 11*a*. In the ripper 11, a claw section 11*b* for breaking a hard ground surface or bedrock is provided on the traveling machine body 1 side (rear side) to oppose an opening section 10*b* of the bucket 10. The claw section 11*b* may obviously be one-clawed or be in a forked shape that is branched to be, for example, two-clawed, three-clawed, or the like.

The ripper 11 is provided with a base end section 11*c* that extends to the opposite side (front side) of the bucket opening section 10*b*. The base end section 11*c* is axially supported to be swingable with a second supporting shaft 12*c* at the tip end section of a rod 12*b* of a hydraulic cylinder 12 that is axially supported at the base end section of the arm 9 with a first supporting shaft 12*a* and provided such that the rod 12*b* protrudes forward. Further, one end section of a connecting link 13 is axially supported to be swingable with a second supporting shaft 11*d* at the intermediate section on the claw section 11*b* side of the ripper 11. The other end section (front end section) of the connecting link 13 is provided with a pin 13*a*. The pin 13*a* penetrates and is supported to be movable at a slot (corresponding to "operation delaying means" of the present invention) 10*d* provided to a base end section 10*c* protruding to the opposite side (front side) of the main body of the bucket 10. In this embodiment, the slot 10*d* is formed by being cut into an upwardly inclined shape, for example on a tangent C, to deviate from an arc B of which the shaft center is the bucket supporting shaft 10*a*. As a reference, in the case where the slot 10*d* is formed along the arc B, support by a slot upper-side circumferential edge 10*g* by the pin 13*a* as described later is lost. Therefore, the bucket 10 is rotated by its own weight in accordance with the contraction of the hydraulic cylinder, and the present invention is not possible.

Figure 7:
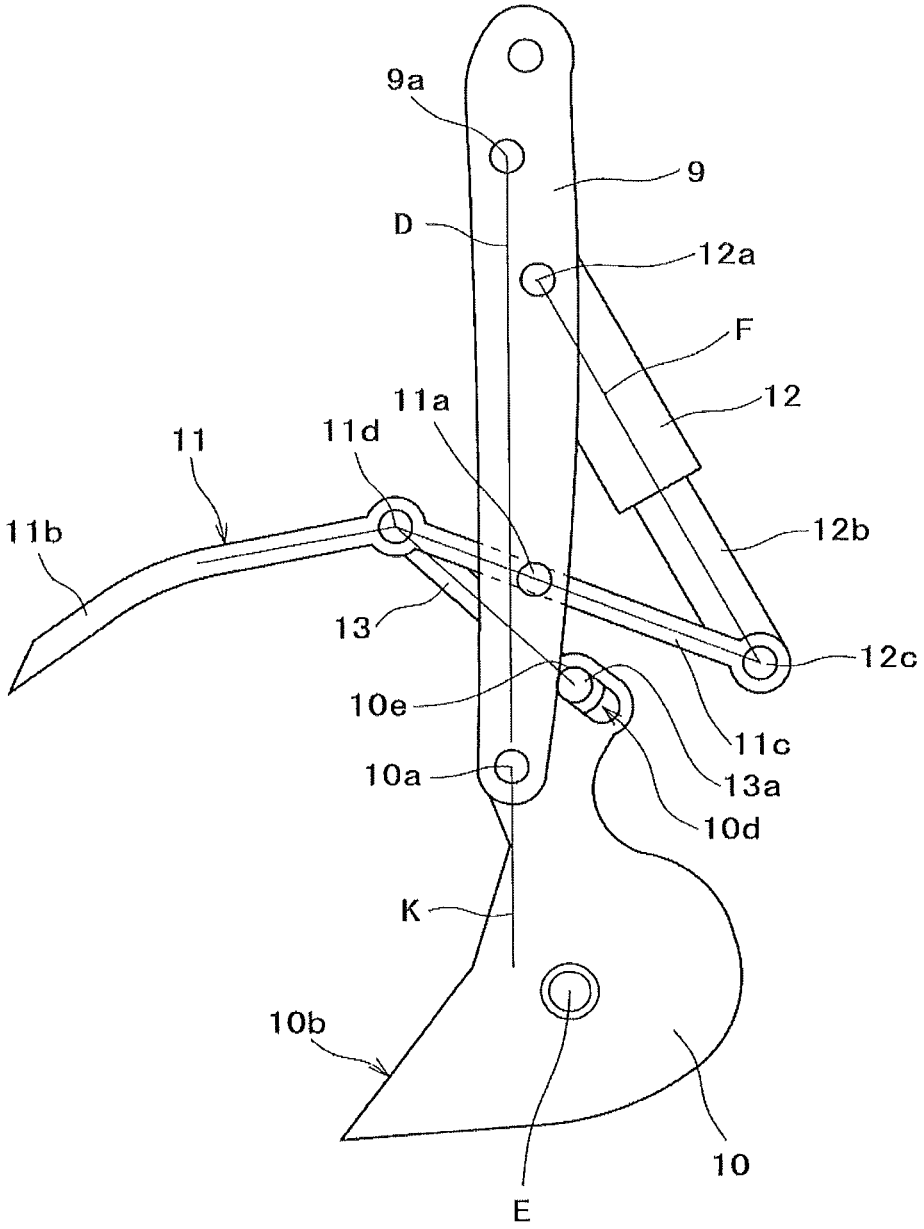
FIG. 7 is a side view showing a state where the hydraulic cylinder has extended maximally when the arm is in a perpendicular posture.

Herein, in a perpendicular posture in which the bucket supporting shaft 10*a* is located on a perpendicular (arm perpendicular) D from the arm supporting shaft 9*a* as shown in FIG. 7, a bucket gravity center E is located in the front relative to the arm perpendicular D. In this state, the bucket 10 tries to rotate rearward with its own weight. Accordingly, the bucket 10 is maintained in a posture in which the pin 13*a* contacts an upper end 10*e* of the slot 10*d*.

Figure 4:
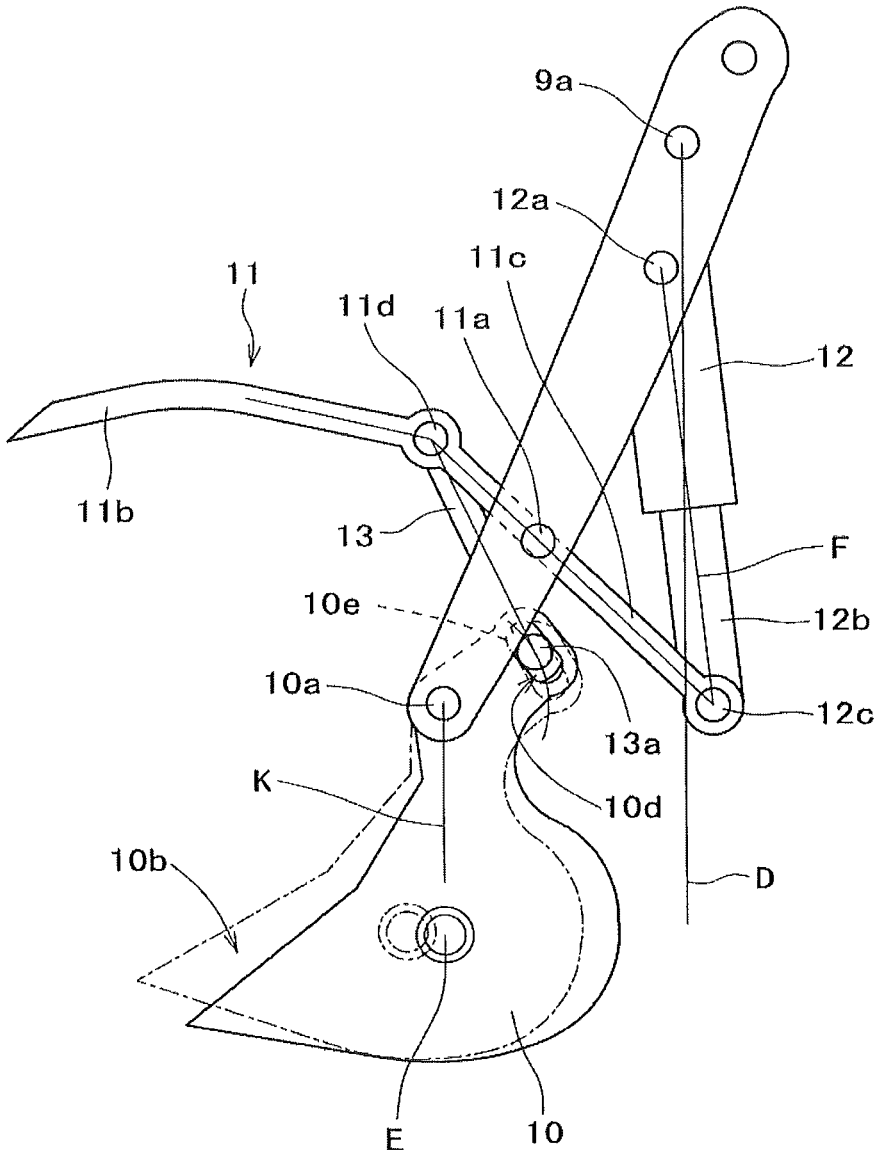
FIG. 4 is a side view showing a state where a hydraulic cylinder has extended maximally when an arm is in a crowding posture.
Figure 5:
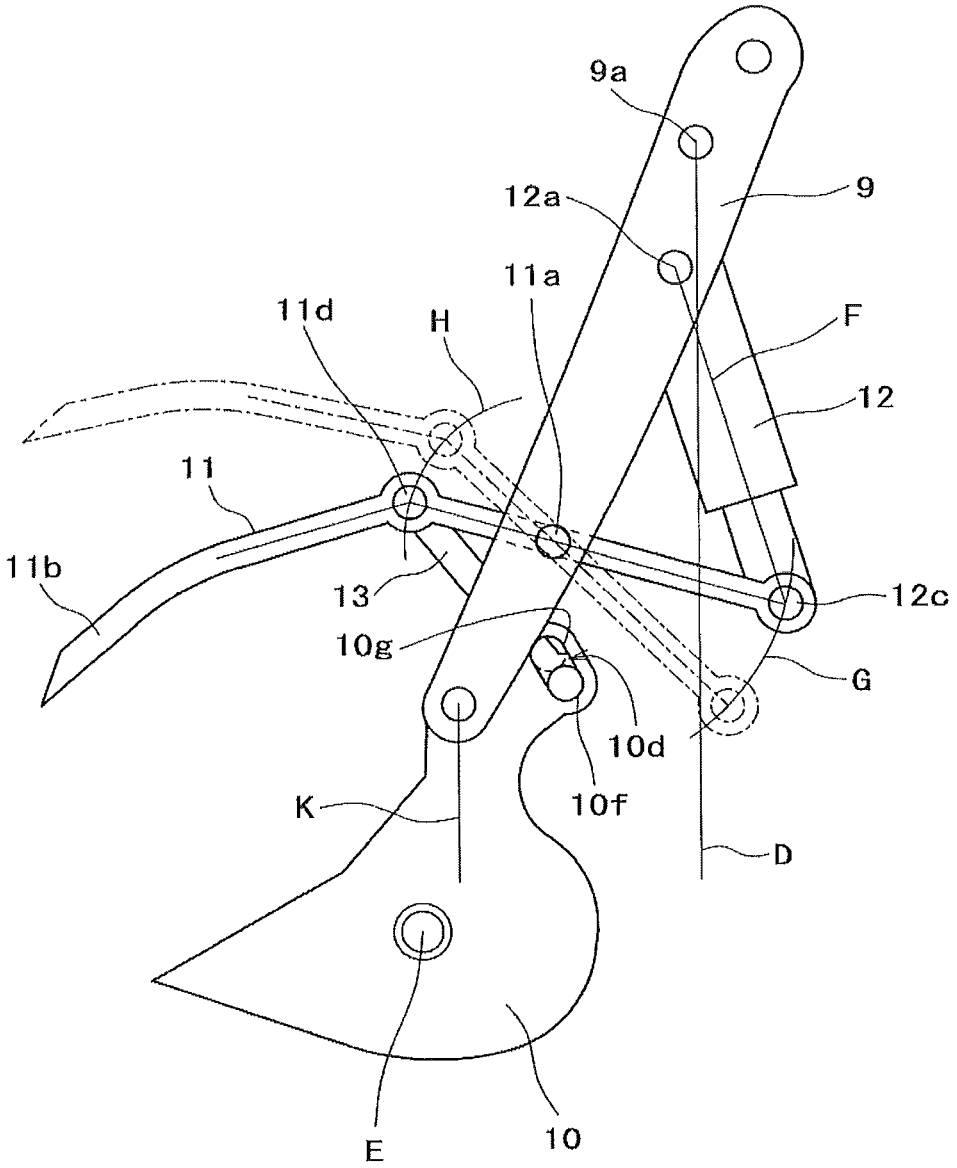
FIG. 5 is a side view showing a state where the hydraulic cylinder has contracted and a pin has moved to a moving end of a slot when the arm is in the crowding posture.
Figure 6:
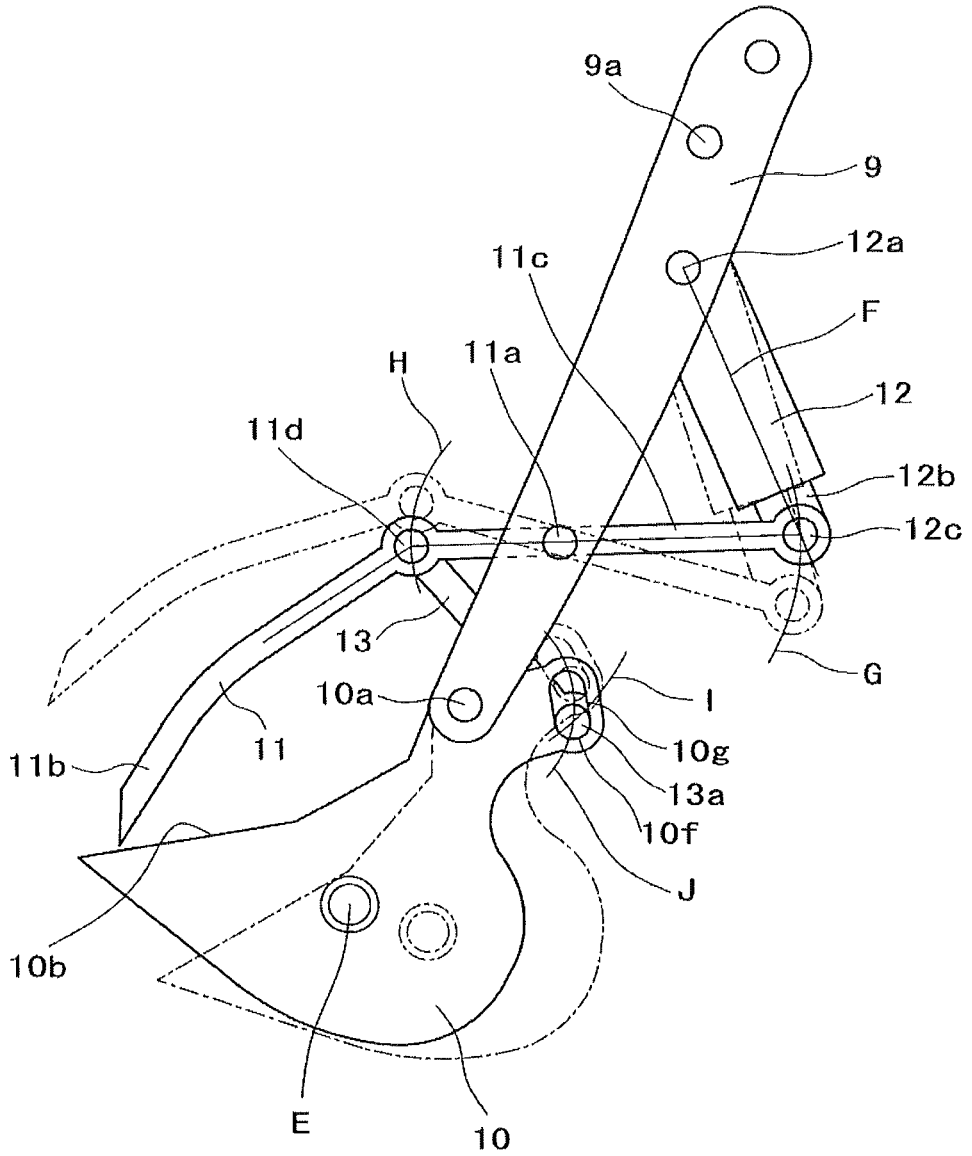
FIG. 6 is a side view showing a state where the hydraulic cylinder has contracted maximally when the arm is in the crowding posture.

FIGS. 4 to 6 show the motion of the front attachment A upon causing an extending or contracting movement of the hydraulic cylinder 12, in the case of the bucket supporting shaft 10*a* being located on the traveling machine body 1 side (rear side) relative to the perpendicular (arm perpendicular) D from the arm supporting shaft 9*a* (an arm crowding posture). When the hydraulic cylinder 12 is in a maximally extended state (see FIG. 4), the setting is such that the bucket gravity center E of the bucket 10 is located on a perpendicular (bucket perpendicular) K from the bucket supporting shaft 10*a* within a range of the slot 10*d*. The setting is such that, accordingly, the bucket 10 sinks from a posture (posture of a virtual line in FIG. 4) in which the pin 13*a* contacts the slot upper end 10*e* to be located in an intermediate position of the slot 10*d*.

When the hydraulic cylinder 12 is contracted from this state, the cylinder second supporting shaft 12*c* is located at the intersection of a center line F of the hydraulic cylinder 12 and an arc G of which the center is the first supporting shaft 11*a*. In the ripper 11 at this time, the claw section 11*b* swings toward the lower side with the first supporting shaft 11*a* as a fulcrum in a state of coordination with the arc G. Meanwhile, the second supporting shaft 11*d* swings on an arc H with the first supporting shaft 11*a* as a fulcrum. Then, the connecting link 13 moves in coordination with the swing of the second supporting shaft 11*d*. The pin 13*a* is brought to a state of being supported at an upper-side circumferential edge 10*g* of the slot 10*d* and moves toward a lower end (front end) 10*f* of the slot 10*d*. During the first half of a contracting process until the pin 13*a* contacts the slot lower end 10*f* (see FIG. 5), the pin 13*a* pushes the slot lower end 10*f* forward, so that a scooping operation of the bucket 10 is absent. During this time, the scooping operation of the bucket 10 is delayed, and only the ripper 11 performs a digging operation with a lower-side swing of the claw section 11*b*, with the first supporting shaft 11*a* serving as a fulcrum.

During the second half of the contracting process from this state until the hydraulic cylinder 12 is further contracted and moved to a maximally contracted state (see FIG. 6), the ripper 11 swings downward along the arc H of the second supporting shaft 11*d* to continue the swing operation of the ripper 11. Simultaneously, the pin 13*a* pushes the slot lower end 10*f* forward and downward up to an intersecting position of an arc I of which the center is the ripper second supporting shaft 11*d* and an arc J of which the center is the bucket supporting shaft 10*a*, so that the bucket 10 performs the scooping operation in which the opening section 10*b* moves upward. Accordingly, the posture is such that the ripper claw section 11*b* covers the bucket opening section 10*b*.

Figure 8:
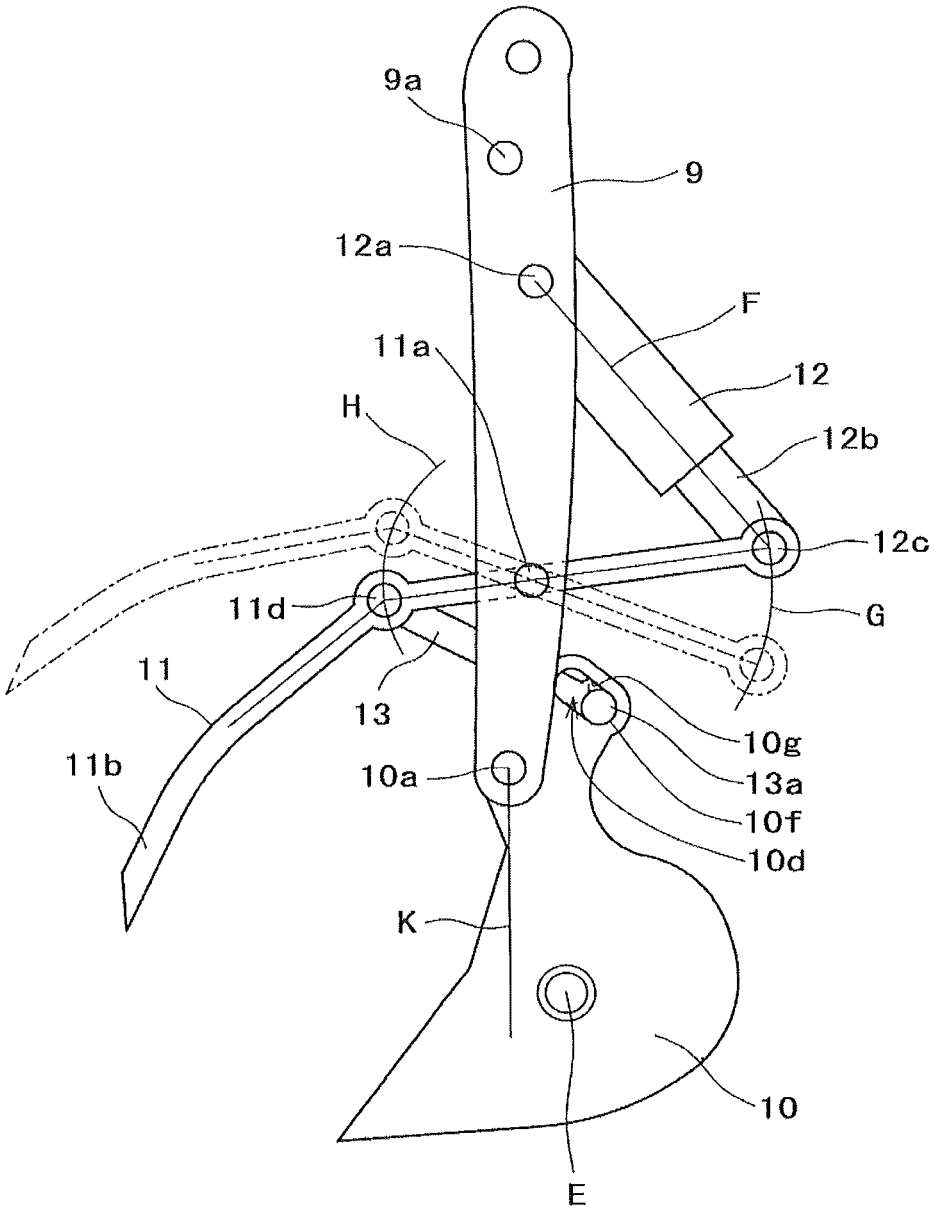
FIG. 8 is a side view showing a state where the hydraulic cylinder has contracted and the pin has moved to a moving end of the slot when the arm is in the perpendicular posture.
Figure 9:
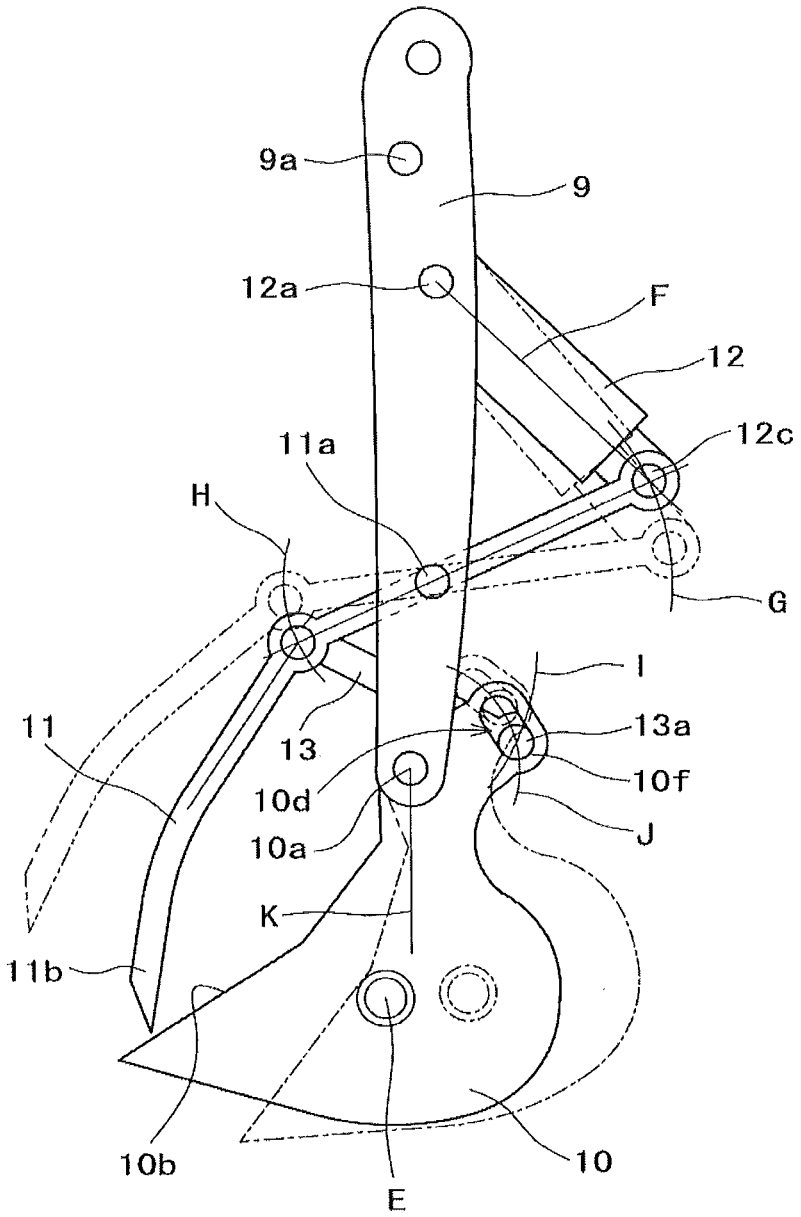
FIG. 9 is a side view showing a state where the hydraulic cylinder has contracted maximally when the arm is in the perpendicular posture.

Next, FIGS. 7 to 9 show the motion of the front attachment A upon causing an extending or contracting movement of the hydraulic cylinder 12, in the case of the bucket supporting shaft 10*a* being located on the perpendicular K from the arm supporting shaft 9*a* (an arm perpendicular posture). (Hereinafter, description relating to the arc or the like is the same and therefore omitted.) In a state where the hydraulic cylinder 12 is maximally extended (see FIG. 7), the bucket 10 is in a posture in which the bucket gravity center E is located in the front relative to the arm perpendicular D. Accordingly, the bucket 10 tries to rotate toward the arm perpendicular D side with its own weight and is in a posture in which the pin 13*a* contacts the slot upper end 10*e*.

In the ripper 11, when the hydraulic cylinder 12 is contracted from this state, the claw section 11*b* swings toward the lower side with the first supporting shaft 11*a* as a fulcrum, while the second supporting shaft 11*d* swings with the first supporting shaft 11*a* as a fulcrum. The bucket 10 is brought to a state where the pin 13*a* is supported at the upper-side circumferential edge 10*g* of the slot 10*d*, and the pin 13*a* moves toward the lower end (front end) 10*f* of the slot 10*d*. During the first half of a contracting process until the pin 13*a* contacts the slot lower end 10*f* (see FIG. 8), the pin 13*a* pushes the slot lower end 10*f* forward, so that a scooping operation of the bucket 10 is absent. During this time, the scooping operation of the bucket 10 is delayed, and only the ripper 11 performs a digging operation with a lower-side swing of the claw section 11*b*, with the first supporting shaft 11*a* serving as a fulcrum.

During the second half of the contracting process from this state until the hydraulic cylinder 12 is further contracted and moved to a maximally contracted state (see FIG. 9), the swinging operation of the ripper 11 is continued. Simultaneously, the pin 13*a* pushes the slot lower end 10*f* forward and downward, so that the bucket 10 performs the scooping operation in which the opening section 10*b* moves upward. Accordingly, the posture is such that the ripper claw section 11*b* covers the bucket opening section 10*b*.

Figure 10:
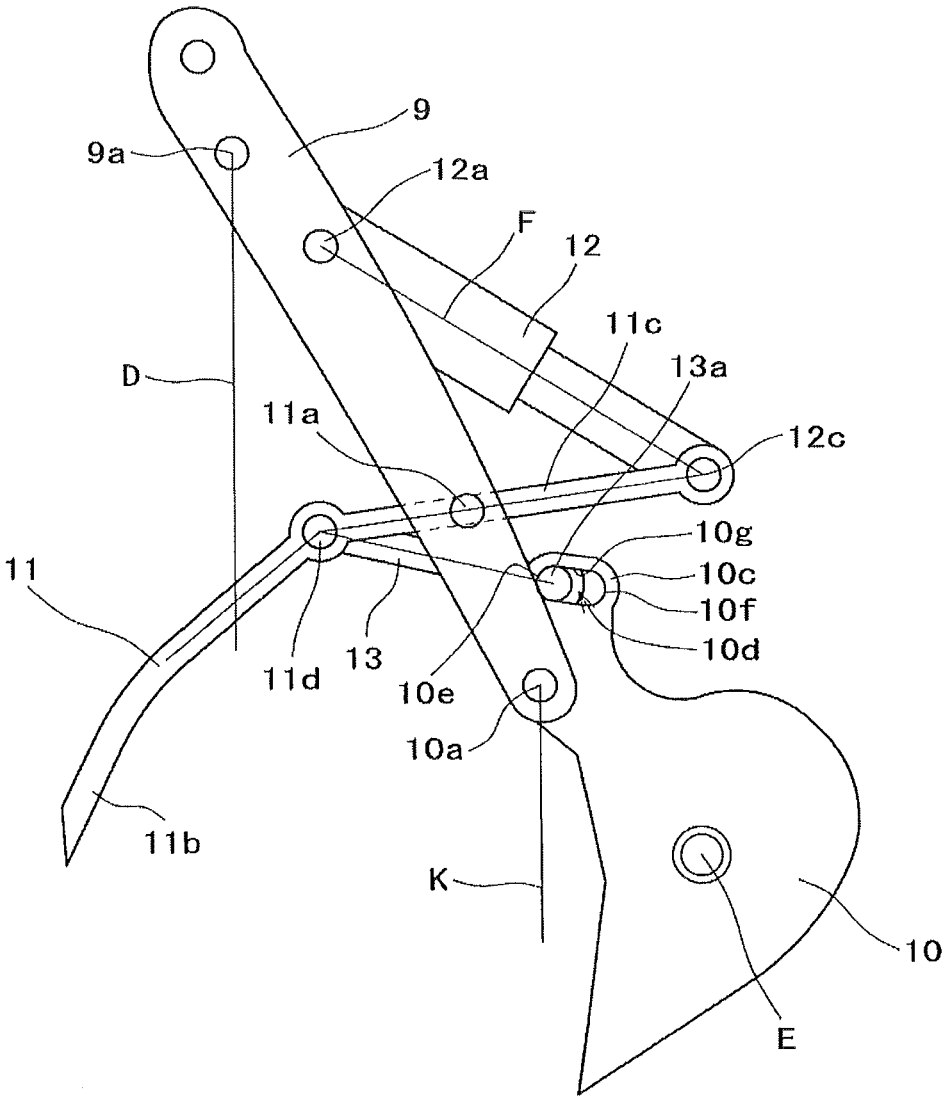
FIG. 10 is a side view showing a state where the hydraulic cylinder has extended maximally when the arm is in a dump posture.
Figure 11:
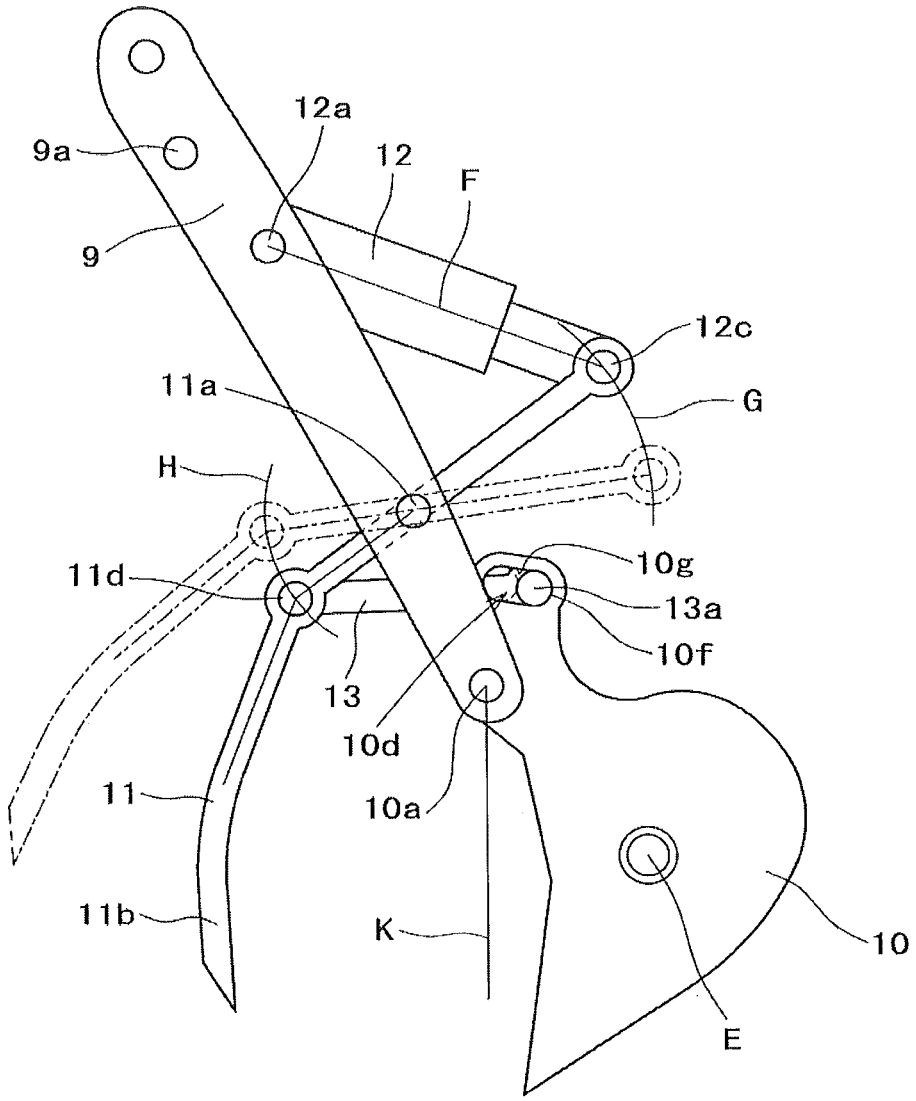
FIG. 11 is a side view showing a state where the hydraulic cylinder has contracted and the pin has moved to the moving end of the slot when the arm is in the dump posture.
Figure 12:
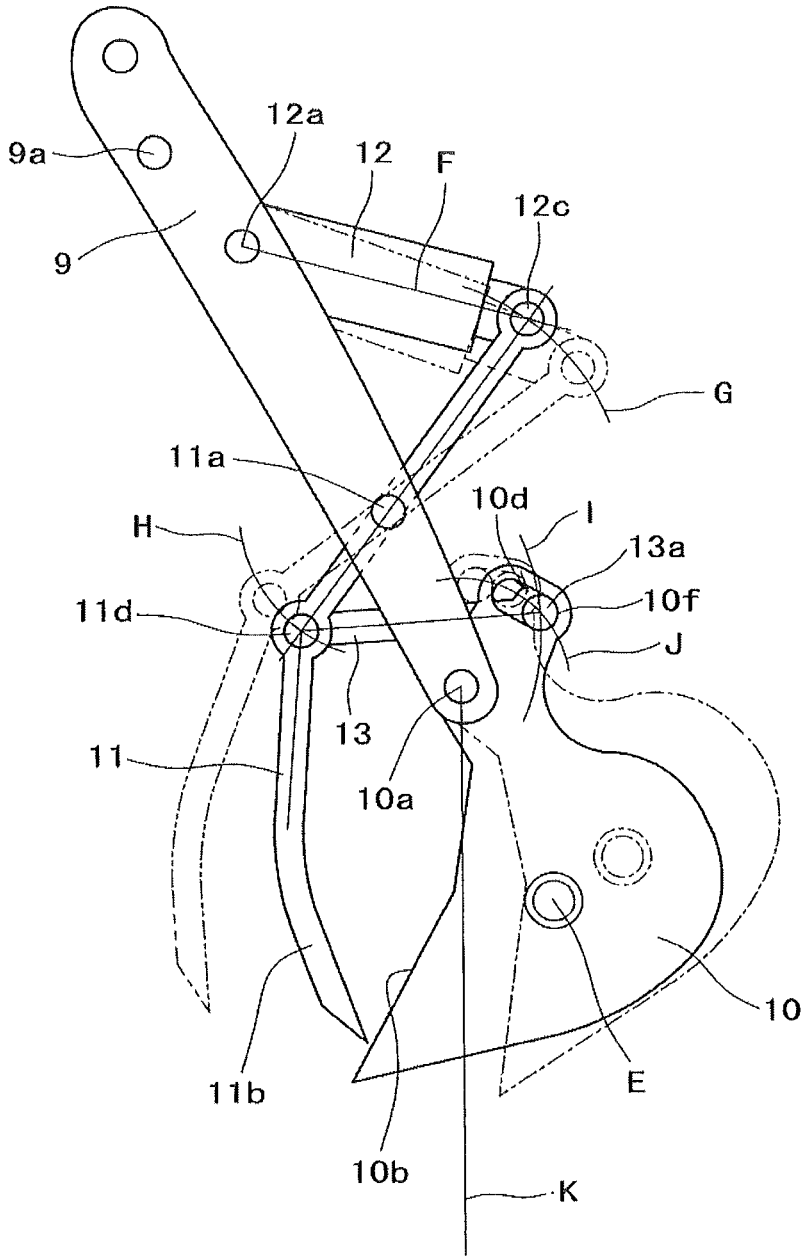
FIG. 12 is a side view showing a state where the hydraulic cylinder has contracted maximally when the arm is in the dump posture.

Further, FIGS. 10 to 12 show the motion of the front attachment A upon causing an extending or contracting movement of the hydraulic cylinder 12, in the case of the bucket supporting shaft 10*a* being located on the front side relative to the arm perpendicular D (an arm dump posture). In a state where the hydraulic cylinder 12 is maximally extended (see FIG. 10), the bucket 10 is in a posture in which the bucket gravity center E is located in the front relative to the arm perpendicular D. Accordingly, the bucket 10 tries to rotate toward the arm perpendicular K side with its own weight and is in a posture in which the pin 13*a* contacts the slot upper end 10*e*.

In the ripper 11, when the hydraulic cylinder 12 is contracted from this state, the claw section 11*b* swings toward the lower side with the first supporting shaft 11*a* as a fulcrum, while the second supporting shaft 11*d* swings with the first supporting shaft 11*a* as a fulcrum. The bucket 10 is brought to a state where the pin 13*a* is supported at the upper-side circumferential edge 10*g* of the slot 10*d*, and the pin 13*a* moves toward the lower end (front end) 10*f* of the slot 10*d*. During the first half of a contracting process until the pin 13*a* contacts the slot lower end 10*f* (see FIG. 11), the pin 13*a* pushes the slot lower end 10*f* forward, so that a scooping operation of the bucket 10 is absent. During this time, the scooping operation of the bucket 10 is delayed, and only the ripper 11 performs a digging operation with a lower-side swing of the claw section 11*b*, with the first supporting shaft 11*a* serving as a fulcrum.

During the second half of the contracting process from this state until the hydraulic cylinder 12 is further contracted and moved to a maximally contracted state (see FIG. 12), the swing operation of the ripper 11 is continued. Simultaneously, the pin 13*a* pushes the slot lower end 10*f* forward and downward, so that the bucket 10 performs the scooping operation in which the opening section 10*b* moves upward. Accordingly, the posture is such that the ripper claw section 11*b* covers the bucket opening section 10*b*.

In the case where the extended hydraulic cylinder 12 is contracted in a configuration in which the bucket 10 and the ripper 11 are provided to the arm 9 in the embodiment for carrying out the present invention configured as described above, the pin 13*a* provided to the connecting link 13 that connects the bucket 10 and the ripper 11 moves in the slot 10*d* provided to the bucket 10 from the upper end 10*e* (or midway) to the lower end 10*f* in the first half of a contracting process. In this first half of the contracting process, a delaying posture in which a scooping swing of the bucket 10 is not performed and stopped is maintained, and the claw section 11*b* of the ripper 11 moves downward (moves to the closing side) to perform a digging operation.

In the second half of the contracting process after the pin 13*a* has reached the lower end 10*f* of the slot 10*d*, the downward movement of the ripper 11 on the closing side is continued, and the pin 13*a* contacts the slot lower end 10*f* to press the base end section 10*c* of the bucket 10 to the front side. The bucket 10 performs a scooping operation in which the opening section 10*b* moves upward, and the ripper 11 operates to close the bucket opening section 10*b*.

When the present invention is carried out in this manner, the bucket 10 and the ripper 11 perform an opening or closing operation in coordination with an extending or contracting operation of the one hydraulic cylinder 12. In the first half of a contracting process of the hydraulic cylinder in this case, only the ripper 11 performs a closing operation, and the bucket 10 maintains a delaying posture to remain stopped. In the second half of the contracting process after the pin 13*a* has reached the front end 10*f* that is a moving end of the slot 10*d*, the bucket 10 also performs a closing operation together with the ripper 11. That is, in the process of contracting the one hydraulic cylinder 12, the bucket 10 performs the closing operation subsequently in a state where there is a time lag with respect to the ripper 11, and a dug object dug by a digging operation can be subjected to a scooping operation with the bucket 10 subsequently in a delayed state with a time lag. A sequence of digging and scooping operations can be performed in a state of having a time lag, and the operation performance is improved.

Since the digging operation by the ripper 12 and the scooping operation by the bucket 10 with a time lag can be performed with an extending or contracting operation of the one hydraulic cylinder 12, simplification of structure can be achieved, and manipulation can be easy even for an inexperienced operator.

Moreover, in the case of digging hard soil, soil dug with the ripper 12 is scooped with the bucket 10. Therefore, wear of the bucket 10 can be reduced compared to a case where both of the digging and scooping operations are performed with the bucket 10 alone.

Moreover, in a configuration of delaying the closing operation of the bucket 10 with respect to the closing operation of the ripper 11 herein, the pin 13*a* provided to the connecting link 13 that connects the bucket 10 and the ripper 11 can move in the slot 10*d* provided to the bucket 10. Thus, the configuration of a delaying mechanism is simple.

The present invention is obviously not limited to the embodiment. The bucket can be replaced with an operating body such as a ripper. The delaying mechanism can be carried out with a slot being provided to a connecting link and a pin being provided to a bucket.

As a reference, the shape of the slot 10*d* is determined based on the first half of a contracting operation of the hydraulic cylinder 12 from a maximally extended state. By determining the respective positions of the upper end (base end) 10*e* and the lower end (tip end) 10*f* of the slot 10*d* that the pin 13*a* contacts in that case and connecting the positions with a line, the bucket can be set to not swing in the first half of the contracting process. The tangent as in the embodiment is obviously not limiting.

INDUSTRIAL APPLICABILITY

The present invention can be utilized as a front attachment provided to a traveling machine body for operation such as a hydraulic shovel.

The invention claimed is:

1. A front attachment in a traveling machine body for operation, comprising:

a first operating body provided to be swingable at a tip end section of an arm;

a second operating body provided to be swingable at an intermediate section of the arm;

a hydraulic cylinder of which a base end section is provided to the arm and a tip end section is provided to a base end section of the second operating body;

a connecting link that connects the first operating body and the second operating body, the first operating body and the second operating body being configured to perform an opening or closing operation in response to an extending or contracting operation of the hydraulic cylinder; and operation delaying means for delaying a closing operation of the first operating body by causing the second operating body to perform a closing operation in advance in a process of contracting the extended hydraulic cylinder provided to a connecting section for the first operating body and the connecting link, wherein the operation delaying means includes a slot provided in the first operating body, and a pin provided to the connecting link to be movable in the slot, and configured to cause only the second operating body to perform the closing operation in advance by the pin moving in the slot in a first period of contracting the hydraulic cylinder, and cause both of the first operating body and the second operating body to perform the closing operation in a second period of contracting the hydraulic cylinder after the pin has moved to an end of the slot.

2. The front attachment in a traveling machine body for operation according to claim 1, wherein the first operating body is a bucket, and the second operating body is a ripper.

* * * * *